US005685223A

United States Patent [19]

Vermuelen et al.

[11] Patent Number: 5,685,223

[45] Date of Patent: Nov. 11, 1997

[54] SIMULATED JACQUARD FABRIC AND METHOD OF PRODUCING SAME

[75] Inventors: Roland Vermuelen, Ghent, Belgium; Leslie Celeste Clark, Winston-Salem, N.C.

[73] Assignee: Microfibres, Inc., Pantucket, R.I.

[21] Appl. No.: 479,987

[22] Filed: Jun. 7, 1995

Related U.S. Application Data

[63] Continuation-in-part of Ser. No. 406,136, Mar. 20, 1995.

[51] Int. Cl.[6] ..... B41M 1/12; B41M 3/00

[52] U.S. Cl. ..... 101/129; 101/115

[58] Field of Search ..... 101/129, 115

[56] References Cited

U.S. PATENT DOCUMENTS

| | | | |
|---|---|---|---|
| 3,989,453 | 11/1976 | Jilla . | |
| 3,999,940 | 12/1976 | Freeman | 8/14 |
| 4,108,595 | 8/1978 | Pappas | 8/1 A |
| 4,146,362 | 3/1979 | Nichols, Jr. | 8/1 XB |
| 4,294,577 | 10/1981 | Bernard | 8/488 |
| 4,438,533 | 3/1984 | Hefele | 2/97 |
| 5,059,452 | 10/1991 | Squires | 428/88 |
| 5,400,485 | 3/1995 | Bialostozky-Krichevsky | 28/163 |

FOREIGN PATENT DOCUMENTS

| | | |
|---|---|---|
| A 2 084 535 | 10/1993 | Canada . |
| A 0 581 537 | 2/1994 | European Pat. Off. . |
| A 460 924 | 3/1937 | United Kingdom . |
| 92/20524 | 11/1992 | WIPO . |

*Primary Examiner*—Edgar S. Burr
*Assistant Examiner*—Daniel J. Colilla
*Attorney, Agent, or Firm*—Wolf, Greenfield & Sacks, P.C.

[57] ABSTRACT

A simulated Jacquard fabric and method of fabrication. A flocked fabric is screen printed with specially engraved screens for each color of the design. Thereafter a blotch screen is used to overprint with dyes at a certain pressure that causes the formation of simulated binding or fine lines to simulate a Jacquard fabric.

4 Claims, 1 Drawing Sheet

SIMULATED JACQUARD FABRIC AND METHOD OF PRODUCING SAME

PRIOR APPLICATIONS

This is a continuation-in-part of application Ser. No. 08/406,136, filed Mar. 20, 1995.

FIELD OF INVENTION

The present invention relates to a method of simulating Jacquard designs and to a simulated Jacquard-design fabric.

BACKGROUND OF THE INVENTION

Jacquard fabrics are conventionally woven on Jacquard looms to form elaborate woven patterns. These patterns are characterized by fine lines or binding lines extending in selected directions of the fabric. Jacquard fabrics may have a rich and luxurious appearance; however, these fabrics are not inexpensive to make. Because of the luxurious appearance of Jacquard fabrics, there is a need for means and methods of simulating such fabrics at lower costs than those heretofore possible.

One problem with respect to reproducing or simulating Jacquard fabrics centers on the textural appearance of these fabrics. Traditional Jacquard fabrics have a tapestry-like appearance, in which some of the richness of the fabric is generated by the three-dimensional effects caused by the bindings or fine lines which are typical of these fabrics. The bindings or fine lines constitute lines usually extending parallel to the warp that are three-dimensionally recessed below the upper surface of the fabric, thus causing an embossed type of appearance.

SUMMARY OF INVENTION

The present invention provides a means by which flocked fabric may be fabricated to simulate Jacquard designs. In the present invention, conventionally formed flocked fabrics may be converted to Jacquard designs in a process which contemplates the application of selective screening techniques to specially selected flocked fabric in a process which results in a simulated Jacquard design. In the present invention, selected greige goods are preferably first pre-washed and then successively printed with peg colors applied using specifically engraved screens for each color in a design. Following application of the peg colors to the fabric surface, the fabric is overprinted with an overall screen blotch that defines the fine lines. Specially selected combinations of dye materials, together with different applications of pressure and rod sizes, are used to achieve the effect.

It is, therefore, an object of the present invention to provide a method of treating flocked fabric to simulate a Jacquard design. It is an object of the present invention to provide an improved method of treating flocked fabric to simulate a Jacquard design by printing the surface of the flocked fabric to simulate a true Jacquard pattern having binding or fine lines clearly displayed and defined thereon. A still further object of the present invention is to provide an improved method of forming simulated binding or fine lines for simulating Jacquard fabrics utilizing selected combinations of dyes and appropriate screen-printing techniques on flocked fabrics. A further object of the present invention is to provide an inexpensive process for simulating Jacquard designs on flocked fabrics.

BRIEF DESCRIPTION OF THE DRAWINGS

These and others details and advantages of the present invention will be described in connection with the accompanying drawings, in which.

DESCRIPTION OF PREFERRED EMBODIMENT

In simulating a Jacquard fabric, it is critical to provide a fabric surface which accurately reproduces the fine binding techniques inherent in the Jacquard print. This fine binding technique involves the reproduction of fine lines or binding on the surface of the fabric, with these lines extending in the warp and fill direction of the fabric. These fine lines or bindings typify the Jacquard fabric.

Figure 1:
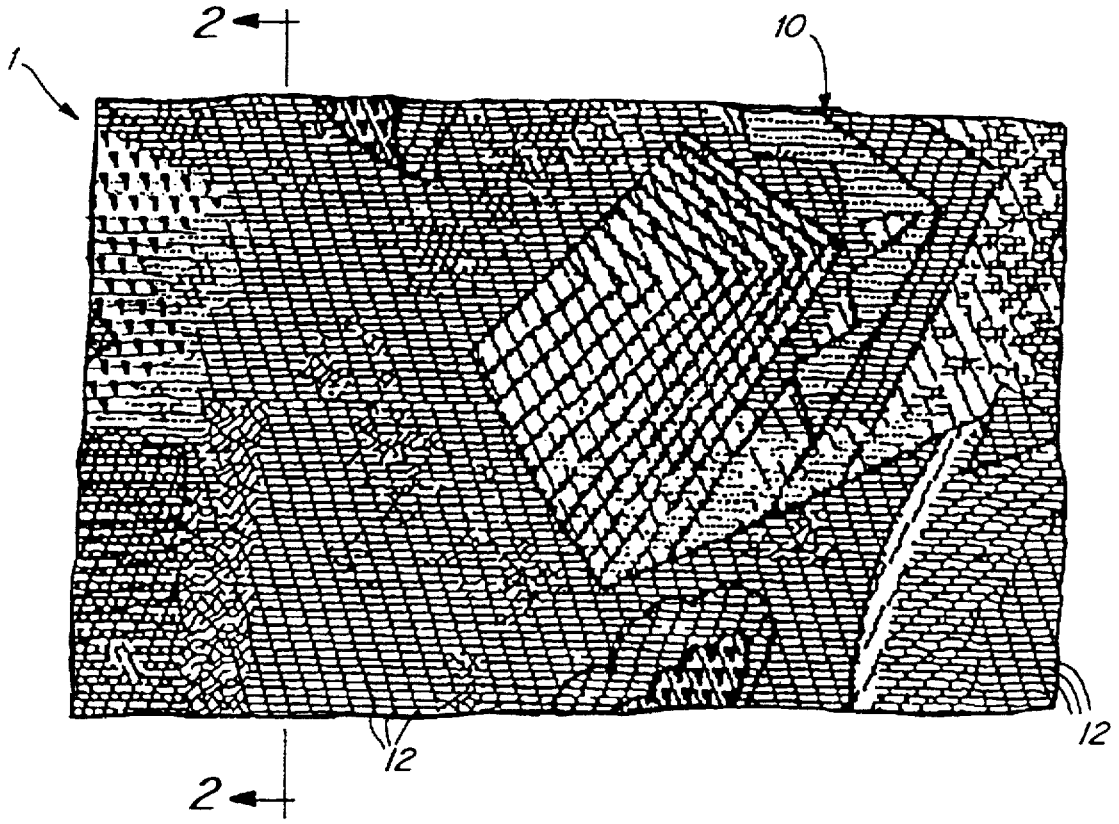
FIG. 1 is a plan view of a simulated Jacquard fabric having fine lines or binding, made in accordance with this invention.
Figure 2:
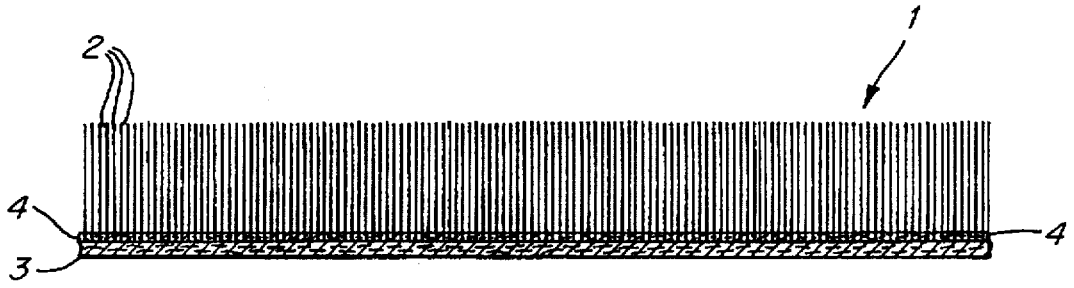
FIG. 2 is an enlarged schematic cross-sectional view taken along Line 2.2 of FIG. 1.

In practicing this invention, the fabric selected is a conventionally formed flocked fabric 1 (FIG. 1). The flocked fabric consists of short fibers 2 (FIG. 2) secured to a substrate 3 by means of a suitable adhesive 4. These fibers 2 form a flock which typically is made of a polyamide fiber. In the present invention, a Nylon 6,6 flock is preferred. The fabric may be adhered by mechanical electrostatic methods. Typically, electrostatic methods may employ those generally described in U.S. Pat. No. 5,108,777, which issued on Apr. 28, 1992. The greige goods preferably comprise a substrate fabric made of a 65/35 polyester/cotton substrate. Conventionally adhered by electrostatic methods or the like is a microdenier fiber, such as a 0.9 denier semi dull Dupont Nylon 6,6 fiber, cut into lengths of 0.030 inches. Preferably the microdenier pile should have erect fibers of 1.1 denier or less with a length of 0.035" or less for better definition. By using a fine denier, the hand of the product is enhanced and will result in a product which is softer than a true Jacquard fabric. The adhesive securing the fibers to the substrate may comprise a water-based acrylic latex with a Tg of −11° C. Thickeners and other chemicals may be added as required to make a flocked adhesive in a conventional fashion. A typical fabric used in this process may comprise a fabric having a total weight of 7.5 plus or minus 0.2 oz/yd$^2$; an adhesive weight of 2.6 plus or minus 0.1 oz/yd$^2$; and a flock weight of 1.4 plus or minus 0.1 oz/yd$^2$.

The greige goods may be used in a preferred embodiment without a washing cycle. In such a process, the fibers will tend to remain erect and there will be a cost saving by elimination of this step. In a second embodiment, the greige goods may be pre-washed by running the fabric through a pad of heated water, preferably in the order of 60° C. A convention pad, such as one made by Krantz-Babcock of Germany, may be used. The greige goods are then dried in an oven at a temperature of in the order of 150° C. The pad is a stainless steel box with rollers designed to remove excess water from the greige goods. The temperature at which the greige goods are dried should not alter the structure of the greige goods or the Nylon 6,6 fibers, and for that reason should be maintained at a temperature of no higher than 200° C. The fabric may be moved through the pad at a maximum speed of about 50 meters per minute. The fabric is padded and framed dry. The greige goods, after washing, should have a more uniform laid pile for improved printing and better print definition.

After the goods are pre-washed and dried, they are rolled onto an A-frame. Following that, the goods are printed. In the printing process, these pre-washed greige goods are fed into a conventional screen-printing machine useful for such a process. Such a machine is the Reggiani Futura machine. The machine may be fitted with 195 Nova or 155 Penta screens, which are available from Stork Screens. The screens used for the peg screens should be fine, with a mesh size of preferably between 125 and 225. The screen forming the blotch screen is coarser and preferably is in the order of 40 to 60 mesh. The screens are placed in the heads of the print machine for successive printing, as further described.

The screens are prepared to print a particular design on the fabric that is passing through the print machine. Thus, for example, if the screens are intended to print a floral or other design 10 simulating a Jacquard fabric, a series of peg screens are prepared for printing various peg colors. Thus, for example, if seven colors are to be used to form a particular pattern, separate peg screens would be prepared for each peg color. Conventionally, these peg colors will print the entire design except for the background design. Conventionally, the background colors are printed with a screen in the last position, which is commonly referred to as a blotch screen. In the present invention, specifically engraved screens are used to print each color in a design. In addition, each of the peg screens is engraved with lines to simulate the binding or fine lines 12 of the Jacquard print. The peg colors are not printed in the position of these lines. Finally, the blotch is printed over the entire fabric surface. The binding or fine lines, when used to simulate a Jacquard print, will usually extend in the warp direction. However, because of the versatility of the process, these lines may extend in any direction and take any shape desired. Thus, the process may be adapted for other purposes, including the simulation of a chenille fabric.

In the printing process, using the Reggiani Futura print machine, the choice of the size of the magnetic rods which press the print paste through the screens onto the flocked fabric and the pressure setting of the rods, combined with the viscosity of the print paste, determine the clarity of printing the binding lines. In the present invention, the peg rods selected have, preferably, a 12-millimeter diameter and are applied with a pressure of approximately 40 Kg/cm, while the blotch screen is at least a 16-millimeter rod applied at a pressure of 50 Kg/cm. The print speed may typically be 20 meters per minute, and the fabric may be dried at a temperature of in the order of 150° C. until the fabric is dry. The fabric may be dried in a steam-heated dry oven built by Reggiani.

The peg rods are used to properly apply and disperse the dyes. Relatively small rods are used to force the dyes through the peg screens, because the binding or fine lines engraved in these screens are so fine that limited pressure should be applied to keep these lines well defined. Greater penetration is desired for applying color using the blotch screen. The application of dyes using the blotch screen is intended to cover the entire fabric surface and to cause the acid dyes to penetrate as deeply as possible into the fabric. For that reason, the rods used should be in the order of 25% or more larger in size than those used for the peg colors. Correspondingly higher pressures are applied using the blotch screen rods. In the process of printing the peg colors, the peg screens define but do not print those portions of the fabric which ultimately define the binding or fine lines.

The drying of the fabric at no more than 150° C. is intended to prevent melting of the Nylon 6,6 and to assure that the dyes properly attach to the surface and inside structure of the fibers.

The material used to print the peg colors includes a printing paste with a resist agent and prerequisite disperse dyes. Thus, when the dye in the blotch screen is applied, the acid dyes are neutralized by the peg screen print paste where there is a peg color printed, but not where the fine lines are defined by the absence of a peg color. There the blotch paste fully penetrates the fabric to show more relief. To apply the peg colors, a conventional paste, resist agent, and disperse dyes are used, with the viscosity of the paste ranging from 6000 to 10,000 centipoise. The viscosity is tested using a Haake VT02 viscometer with a rotor speed of 62.5/min, rotor spindle 1, diameter 24 mm and height 53 mm. This composition preferably comprises a solid-color dye dispersed in the paste. More specifically, it may consist, typically, of a composition of water with a synthetic thickener, such as an acrylic acid polymer supplied by Allied Colloids of the United Kingdom. A typical resist agent is Thiotan TR, made by Sandoz (Switzerland). The dyes are typical dispersed dyes selected for their light fastnesses and crock resistance on polyamide 6,6.

One print formula for the peg colors may comprise

| | | |
|---|---|---|
| x g | water | |
| 50 g | acrylic paste: | Alcoprint RTA (Allied Colloids - UK), Lambicol 190 (L. Lamberti - Italy), or 475 Concentrate (Morton - UK) |
| 100 g | resist agent: | Thiotan TR (Sandoz - Switzerland), Lyoprint 4401 (Ciba Geigy - Switzerland), or Gascoreserve Tan 2E (CGI Technologies - US) |
| y g | disperse dye: | Any selected disperse colors having adequate light fastness on nylon; e.g. Palanil Yellow 3G, Blue Resolin FBL, Transcorona Red TGWN. |
| 1000 g | peg screen printing paste | |

where x and y = 850 g and x is preferably larger than y preferably in range 80% to 90% of x and y.

An acrylic paste and acid dye suitable for the purposes described should be used to apply the fine or binding lines, since those lines tend to be a predominant color in the print. The viscosity of the acrylic paste for the blotch screen application ranges from 4000 to 4500 centipoise. The specific acceptable acrylic paste and acid dye is a composition of water with a synthetic thickener, typically acrylic acid polymers from Allied Colloids, UK, with an acid donor (typically an ammonium tartrate with acid dyes).

A print formula for the blotch paste may comprise:

| | |
|---|---|
| x g | water |
| 60 g | acrylic paste similar to those used for the peg colors |
| 60 g | ammonium tartrate (acid donor) |
| y g | acid dye or premetalized dye. Must be a dye which is capable of being resisted by the peg screen formulation. |
| 1000 g | blotch screen printing paste |

where x and y = 880 g and x is preferably larger than y and preferably in the range of 80% to 90% of x + y.

After the goods have been printed, they are steamed for a period of time, usually 20 to 30 minutes, in saturated steam at about 101° to 102° C. The temperature and time may vary. The purpose of steaming the goods is to fix the acid and disperse dyes into the fiber.

After the goods have been printed, they are washed and dried at 150° C. at a line speed of about 50 minutes per meter. Excessive dye and print paste are removed from the fabric when it is washed.

After the goods have been washed, they are rolled onto an A-frame and prepared for finishing. A finishing process includes passing the goods through a pad containing a softener and squeeze rolls to remove excess water and softener from the fabric before it is dried. The goods are then passed into a pre-dryer and the main oven for drying. The fabric is carried through a machine on a tenter frame. A 4% solution of a silicone softener is applied to the goods in the pad while it is drying at 150° C. in a pre-dryer and at 180° C. in the main oven, where it is conveyed at a line speed of about 50 meters per minute.

While the present invention focuses on making a Jacquard-style fabric, the process may also be adapted to simulate a chenille-like fabric. In such a process, the textured feel of the chenille fabric may be effected by post embossing the fabric after the coloring process.

In the case of the Jacquard fabric, post embossing may also be effected to improve the textured feel.

Having thus described one particular embodiment of the invention, various alterations, modifications, and improvements will readily occur to those skilled in the art. Such alterations, modifications, and improvements are intended to be part of this disclosure and are intended to be within the spirit and scope of the invention. Accordingly, the foregoing description is by way of example only and is not intended as limiting. The invention is limited only as defined in the following claims and the equivalents thereto.

What is claimed is:

1. A method for treating a flocked fabric to simulate a Jacquard fabric comprising preparing an engraved screen for each color to be applied, sequentially applying a series of different colored dyes to the flocked surface of the fabric using specifically engraved screens for each color to form a multicolored pattern defining uncolored areas for application of fine lines and thereafter applying dye in a composition having lower viscosity than the dyes forming the pattern to selected portions including said uncolored areas of said fabric using a blotch screen.

2. The method as set forth in claim 2, wherein the dyes used to form the multicolored pattern are mixed with a resist agent and said dye used to form said lines comprise an acid dye.

3. A method for treating a flocked fabric to simulate a Jacquard fabric comprising preparing an engraved screen for each color to be applied, sequentially applying a series of different colored dyes to the flocked surface of the fabric using specifically engraved screens for each color to form a multi-colored pattern, thereafter applying dye in a composition having lower viscosity than the dyes forming the pattern to selected portions of said fabric using a blotch screen and wherein the pressure exerted on the dyes when applied to the screens to form the pattern are less than the pressures applied to the dye used in the blotch screen.

4. A method as set forth in claim 3 wherein a blotch screen is used to apply a background pattern and wherein said blotch screen has a mesh in the order of 40 to 60.

* * * * *